United States Patent [19]

Holinski et al.

[11] Patent Number: 4,755,308

[45] Date of Patent: Jul. 5, 1988

[54] HIGH TEMPERATURE SCREW LUBRICATING PASTE

[75] Inventors: Ruediger Holinski, Munich; Wilhelm Huber, Tiefenbach, both of Fed. Rep. of Germany

[73] Assignee: Dow Corning GmbH, Munich, Fed. Rep. of Germany

[21] Appl. No.: 11,179

[22] Filed: Feb. 4, 1987

[30] Foreign Application Priority Data

Feb. 10, 1986 [DE] Fed. Rep. of Germany ..... 3604104

[51] Int. Cl.[4] ..... C10M 125/10

[52] U.S. Cl. ..... 252/18; 252/28; 252/20; 252/21; 252/27; 29/458

[58] Field of Search ..... 252/28, 18, 25

[56] References Cited

U.S. PATENT DOCUMENTS

| | | | |
|---|---|---|---|
| 459,789 | 1/1937 | Townsend | 252/18 |
| 2,671,758 | 3/1954 | Vinograd et al. | 252/25 |
| 2,676,925 | 4/1954 | Lindstrom et al. | 252/18 |
| 2,754,266 | 7/1956 | Stegemeier et al. | 252/18 |

FOREIGN PATENT DOCUMENTS

| | | | |
|---|---|---|---|
| 113804 | 10/1978 | Japan | 252/25 |
| 58-40393 | 3/1983 | Japan . | |

*Primary Examiner*—William R. Dixon, Jr.
*Assistant Examiner*—Jerry D. Johnson
*Attorney, Agent, or Firm*—Alexander Weitz

[57] ABSTRACT

A high temperature screw lubricating paste is described which consists essentially of finely divided tin dioxide and, optionally, a thermally stable inorganic filler homogeneously dispersed in a carrier oil. The inert paste may be used with threaded connections to provide a low break-away torque when the connections are exposed to high temperatures for extended periods.

10 Claims, No Drawings

HIGH TEMPERATURE SCREW LUBRICATING PASTE

BACKGROUND OF THE INVENTION

This invention relates to a high-temperature screw lubricating paste. More particularly, this invention relates to a homogeneous preparation of tin dioxide, or tin dioxide mixed with a thermally stable inorganic filler in a carrier oil.

Threaded connections are used in all kinds of industrial branches to firmly assemble the various types of structural members and to disassemble them easily when the occasion arises. In all cases of threaded connections being exposed to extreme stress by high temperatures or pressures, possibly also combined with a heavy stress due to corrosion, these threaded connections (screws and nuts) are made of high strength materials. Usually in such cases materials are selected from austenitic steels or nickel base alloys which, in addition to their special mechanical strength and high-temperature strength, have at the same time an excellent corrosion resistance. Threaded connections from materials such as these are used for instance for turbines, internal combustion engines, chemical industry fittings, gas producers and oil refinery facilities.

To prevent damages, as for instance seizure and galling, in threaded connections such as these, an effective lubrication, namely a possibly complete separation of the thread surfaces, is a must. To achieve this, high-temperature screw lubricating pastes are normally used which are based on the various finely divided inorganic solids being prepared in mineral oils and/or synthetic oils as carrier oils.

The high-temperature pastes commonly in use normally contain as solids graphite or other solid lubricants such as molybdenum disulfide and/or metal powders such as lead, zinc, copper or nickel. These solid-containing pastes are, however, not satisfactory in every respect, as they meet the following requirements only in part or insufficiently:

(a) Easy dismantling of the threaded connection after high-temperature operation, i.e. a break-away torque that is not too high.

(b) Coefficient of friction between approximately 0.10 and 0.14$\mu$ with as little variation as possible after repeated loosening and tightening.

(c) Temperature stability of the lubricating layer up to approximately 1200° C.

(d) Good corrosion resistance.

(e) No reaction with the screw material.

Careful investigations revealed that the unsatisfactory behavior of the known solid-containing screw pastes during high-temperature operation is to a great extent likely to be due to the fact that the metallic (and possibly also halogen-, phosphor- or sulfur-containing) constituents of such pastes react with screw materials such as austenitic steels or nickel base alloys and lead to metallurgical changes resulting in cracking, flank fractures or even bolt fractures. Graphite leads to carburization of the screw material, forming chromium carbide with microstructural changes and intercrystalline brittleness. Lead melts, diffuses along the grain boundaries into the austenite and produces cracking and brittleness of solder. The same is true for zinc, too. The use of copper is disadvantageous in so far as at high temperatures it can lead to the so-called red shortness. Nickel powder is numbered among the carcinogenic substances. Halogen-, phosphor- and sulfur-containing components decompose at high temperatures, setting these elements free and leading to metallurgical changes and damages of the screw material.

SUMMARY OF THE INVENTION

The invention is therefore based on the problem of providing a new high-temperature screw lubricating paste which does not show the above-mentioned disadvantages of the high-temperature pastes known in the art and, which in comparison thereto, is superior mainly by meeting the requirements listed under (b) to (e) to a well-balanced extent. Above all, a paste such as this is to comply with the requirement mentioned above under (a), i.e. it is to ensure that even after high-temperature operation the threaded connections can be dismantled easily and without any difficulties due to an especially low break-away torque.

This invention, therefore, relates to a homogeneous composition consisting essentially of: (A) from 30 to 75 percent by weight of a finely divided solid mixture of tin dioxide with an inorganic filler selected from mineral silicates, synthetic silicates or metal oxides, wherein the ratio of said filler to said tin dioxide is between 0:1 and 3:1 and said filler is thermally stable up to 1200° C.; and (B) from 25 to 70 percent by weight of a carrier oil selected from mineral oil, synthetic oils or mixtures of mineral oil with synthetic oil.

This invention further relates to a process of using the above composition as a high temperature screw lubricating paste.

DETAILED DESCRIPTION OF THE INVENTION

As compared with the high-temperature pastes known in the art, the new screw lubricant of the invention is superior with respect to high temperature stability and pressure stability, so that it is temperature-resistant up to at least +1200° C. It shows adhesive strength, a good separating effect and a good sealing of the thread flanks and resists any corrosive influences. It provides threaded connections which, after repeated tightening and loosening do not exhibit any reduced friction and thus have a constant pre-stress. The coefficient of friction of this screw lubricant is approximately 0.10 to 0.14$\mu$ and is thus approximately corresponding with the coefficient of friction of untreated and merely oiled screws. Even at very high temperatures it does not react with the screw material and results in a threaded connection which can be dismantled without any problems and which, above all, shows a considerably lower break-away torque than the various high-temperature pastes known in the art.

The special behavior of the high-temperature screw lubricating paste, as against the known high-temperature screw lubricants. is based, above all, on the new element of using tin dioxide as an exclusive or essential part of the solid component. This compound is extremely stable against high temperatures and has no melting point, but rather sublimes at temperatures above approximately 1800° C. This means that the particles of the finely divided inorganic solid component, consisting of either tin dioxide or of a mixture thereof with an inert filler of the mentioned type, do not melt and bake at the surface, so that neither any adhesion of the threaded connections, nor any change in their material structure, can occur.

As a tin dioxide, any tin (IV)-oxide which is available in a powdery, and thus sufficiently finely divided form, can be used according to the invention. Thus, for instance, the various commercial tin dioxide types are suitable for this, such as those used in the ceramics industry to produce coloring bodies as well as to anneal and tarnish glazes, frits and enamel. These types of tin dioxide normally have a tin dioxide content of at least 99% up to 99% and thus contain only slight impurities of other metals such as iron, nickel, chromium, aluminum and silicon. Their specific weight is approximately 6.9 g/cm$^3$. The grain distribution of such types of tin dioxide is normally 0.4 to 60$\mu$m, the grain maximum normally ranging between 0.5 and 5 680 $\mu$m. The various types of tin dioxide are thus distinguished essentially by different specific bulk weights and compacted apparent weights and surfaces as well as grain distributions and grain maxima. Types of tin dioxide being suitable according to the invention have for instance bulk weights of approximately 700 to 250 g/l, compacted apparent weights of approximately 1000 to 350 g/l and surfaces of approximately 10000 to 45000 cm$^2$/g.

Especially preferred according to the invention are, above all, such high-temperature screw lubricating pastes whose solid component consists essentially of only tin dioxide, as threaded connections treated with pastes such as these show especially favorable, i.e. low, break-away torques after high-temperature operation.

Tin dioxide is, however, relatively expensive, so that high-temperature screw lubricating pastes having a solid component of just tin dioxide are used only where a paste ensuring especially low break-away torques in the case of high-temperature operation or under other unfavorable conditions is a must. The high-temperature screw lubricating pastes of the invention therefore generally contain tin dioxide only in such amounts as are necessary to ensure the sufficiently low break-away torques which are necessary for the respective operation. For reasons of economy, pastes are also used which have a slightly higher break-away torque wherein part of the tin dioxide is replaced by another solid component, namely by an inert, thermally stable, finely divided, inorganic filler. Thus in pastes such as these, mixtures of tin dioxide and a suitable filler of this kind are used.

The high-temperature screw lubricating paste of the invention generally contains such amounts of solid component (no matter whether tin dioxide or a mixture of tin dioxide and a filler) that, depending on the kind and viscosity of the respective carrier oil, a pasty preparation, namely a paste that is easy to spread is obtained. The amounts and proportions of tin dioxide, and possibly available filler, which are present in the high-temperature screw lubricating paste of the invention are therefore dependent on the product data of the respective components, such as their specific weight, grain size and grain distribution, bulk weight, compacted apparent weight, surface, geometric form and the like. Preferably, the solid component in the high-temperature screw lubricating paste of the invention amounts to approximately 30 to 75 percent by weight, and especially about 40 to 60 percent by weight of the paste, a paste that has only tin dioxide as a solid component generally containing approximately 45 to 55 percent by weight of tin dioxide.

In case the solid component also contains a finely divided inorganic filler in addition to tin dioxide, then the filler is generally available in an amount that the weight ratio of filler to tin dioxide is between 0:1 and 3:1. Although with an increasing content of filler the break-away torques of such screw lubricating pastes increase slightly versus screw lubricating pastes which contain only tin dioxide, this is normally put up with for economic reasons because of the savings of expensive tin dioxide resulting therefrom. The tolerable weight ratio of tin dioxide to filler is naturally also dependent upon the kind and composition of the filler that is present in each case, so that high-temperature screw lubricating pastes containing more than three times the amount of filler in proportion to the amount of tin dioxide are no longer useful. For reasons of the above mentioned consideration of saving as much expensive tin dioxide as possible and putting up with a break-away torque of the threaded connection treated with a corresponding paste, which is just tolerable for the respective kind of application, according to the invention high-temperature screw lubricating pastes are preferred which contain in their solid component tin dioxide and filler in a weight ratio of 1:1 to 1:3, and especially of 1:1.5 to 1:2.5. Especially preferred is a weight ratio of tin dioxide to filler of approximately 1:2.

Generally, the higher the specific weight of the filler, the lower is its proportion in the mixture of tin dioxide and filler forming the solid component.

The finely divided inorganic filler to be used in the high-temperature screw lubricating paste of the invention, as was already mentioned, can be any material that is inert and thermally stable up to the respective maximum application temperatures, for instance, at least +1200° C. This means that any material can be used as a filler that has hitherto been used as a shared or single solid component in known high-temperature pastes. Here, however, all materials are ruled out which, during the respective high-temperature operation, are not stable in combination with tin dioxide or the material forming the threaded connection, i.e. which melt, decompose or emit corrosive or toxic components or are already toxic from the beginning. Of course, fillers such as these must not bring about a disturbing decrease of the coefficient of friction (approximately 0.10 to 0.14$\mu$) of the respective screw lubricating paste. In addition to the above-mentioned general features, there are no other essential requirements necessary for a filler that is suitable according to the invention, and therefore the skilled person will easily select the respective fillers or filler mixtures.

The filler to be used according to the invention is sufficiently finely divided in correspondence with the present purpose of application and, within that scope it may be for instance, grained, fibrous or laminated. Its grain distribution in general mounts to approximately 0.5 to 80 $\mu$m, fibrous fillers normally having diameters of approximately 2 to 10$\mu$m and a length of up to a maximum of 3 mm. In respect of all of these particle size data, downwards or upwards deviations are naturally possible and the selection of the particle size which is suitable in each case is dependent upon the kind and composition of the respective filler and is known to the person skilled in the present technology.

Generally the various mineral and/or synthetic silicates or metal oxides or heavy metal powders can be used as fillers. These meet the above-mentioned requirements and are stable for extreme applications, above all up to temperatures of at least +1200° C.

Preferred fillers of the invention are mineral and/or synthetic inosilicates, namely so-called chain silicates, double chain silicates or ibboned silicates, such as the various fibrous or fingery asbestos, serpentines or hornblendes, and/or phyllosilicates, namely the so-called laminated or stratified silicates, such as the various laminated or stratified mica, the most important of which are biotite and muscovite.

Instead of mineral fillers, use can also be made of synthetic products which are classed under the general term mineral fibers and which are, for instance, mineral wool and slag wool. Also, the ceramic fibers, which recently have gained in importance, are suitable fillers according to the invention, especially since they possess particularly outstanding high-temperature stability. Preferred fillers of the invention are therefore based on asbestos and/or mica and/or synthetic mineral fibers which are related thereto as to composition and structure.

A type of asbestos which is available on the market and which is suitable as filler is, for instance, ASARCO 7 D4 BL of the Lake Asbestos Company. CA-Quebec, with an average particle diameter of 2 to 10μm and a length of approximately 3 mm.

Types of mica which are as well available on the market and which are suitable as fillers, are for instance the so-called English Mica which can be obtained from George M. Langer & Co. (LANCO), D-2863 Ritterhude, West Germany. This mica has an average chemical composition of approximately 48% silicon dioxide, 33% aluminum oxide, 10% potassium oxide, 2% iron oxide, 0.80% sodium oxide, 0.70% magnesium oxide, 0.65% titanium dioxide and 0.50% calcium oxide, the residue consisting of other elements and moisture. The particle size of this type of mica ranges between 5 and 75 μm with maximum particle sizes between 25 and 150 μm, and they have an oil adsorption, type M having an average particle size of 5 to 10 μm with a maximum particle size of 25 μm and an oil adsorption of 75.

The use of asbestos is increasingly considered a health hazard, so that there are already several asbestos-like synthetic substitutes comprising the especially advantageous properties of asbestos without having their toxic side effects. The substitutes belong to the group of the already mentioned synthetic mineral fibers such as the so-called Inorphil Fibers which are offered by the firm Laxa Bruk, W. Germany, under the trade name S-LAXA. The product Inorphil 060 has, for instance, a density of approximately 2.75 and a hardness (Mohs) of approximately 6 to 6.5, having an average composition (weight percent) of 46% silicon dioxide, 15% calcium oxide, 12% magnesium oxide, 15% aluminum oxide, 2.5% sodium oxide, 1.5% titanium dioxide, 6.5 iron oxides and 0.5% residue. Synthetic fibers such as these are further examples of fillers which can be used advantageously in the high-temperature screw lubricating paste of the invention.

As was already mentioned, metal oxides meeting the above requirements can also be used as fillers in the present screw lubricating paste, particularly thermally stable metal oxides which have, for instance, a temperature stability of up to at least +1200° C. and which are, of course, inert. Examples of such metal oxides, even though they are less preferred as fillers, are the various iron oxides, titanium dioxide, magnesium oxide or barium oxide. The specific weight of these oxides is not essentially different from the specific weight of the silicates which are preferred as fillers, so that normally they can also be used in the corresponding quantities and quantity ratios to the tin dioxide. Of course, they can also be used in a mixture with silicate fillers.

In the high-temperature screw lubricating pastes of the invention, heavy metal powders can also be used as fillers or as filler components, even though they are not particularly preferred. Such heavy metal powders as well must of course meet the basic requirements necessary for fillers which are considered suitable according to the invention. Examples of heavy metal powders such as these are titanium powder, molybdenum powder and chromium powder. These can be used in mixtures with other fillers as well but, due to the essentially higher specific weight of the metal powder versus the other fillers, it will in this case be necessary to use these metal powders in higher quantities than the fillers having a lower specific weight. Therefore their maximum weight portion is usually increased by approximately 20 to 35 percent by weight versus the maximum weight portion of the other fillers.

The carrier oil present in the high-temperature screw lubricating paste of the invention can be any mineral oil and/or synthetic oil that is commonly used in the known screw lubricating pastes of that kind. It is merely a carrier component for the solid component present in screw lubricating pastes such as these and is used in such a quantity that, in combination with the kind and quantity of the respective solid component, the required pasty preparation is obtained. Mineral or synthetic carrier oils suitable according to the invention have, for instance, a kinematic viscosity in the range from 60 to 250 $mm^2/s$ at 50° C. and are, in the case of mineral oils, highly viscous base oils or naphthenic lubricating oils. Due to their favorable prices, mineral oils are usually preferred, particularly white oil, as these oils are practically sulfur-free. Synthetic oils can, however, be used in whole or in part instead. These are preferably one or more esters of saturated monocarboxylic and/or dicarboxylic acids with monovalent or polyvalent alcohols.

In addition to the above-mentioned essential constituents of an inorganic solid component (tin oxide or a mixture of tin oxide and a thermally stable finely divided filler) and a carrier oil, the high-temperature screw lubricating paste of the invention can also contain small quantities of other admixtures commonly used for such pastes, for instance paste stabilizers, anticorrosive agents or coloring pigments, provided that admixtures such as these do not impair the essential properties required for the screw lubricating pastes. Such admixtures are, for instance, very finely divided silicon dioxide, bentonite or aluminum powder, the latter being present only in such a small quantity, that the respective paste gets a silver-metallic appearance.

In the following, the invention is further explained by means of examples, followed by statements on the effects of the high-temperature screw lubricating paste of the invention in comparison with screw lubricating pastes of the prior art. All quantities and percentages are on a weight basis unless indicated to the contrary.

EXAMPLE 1

In a laboratory planetary mixer operated at room temperature, 1000 g of tin dioxide (tin(IV)-oxide content 99.9%, grain distribution 0.4 to 60 μm, bulk weight approximately 500 g/l, compacted apparent weight approximately 600 g/l, surface approximately 20,000 $cm^2/g$) (product TEGO-VN) was carefully mixed for approximately 1 hour with 1000 g of a paraffinic mineral oil (white oil having a viscosity of 16.5 $mm^2/s$ at 40° C.). The resulting paste was then completely homogenized by means of a laboratory three-cylinder mull.

EXAMPLE 2

Using the method described in Example 1, 330 g of tin dioxide and 660 g of mica with an average particle size of 5 to 10 μm, a maximum particle size of 25 μm and an oil adsorption of 75 (English Mica, type M, Georg Langer & Co.) was mixed with 1010 g of paraffinic mineral oil to form a homogeneous paste (the mica had a moisture content of 0.10% and an average composition by percent of 47.9% silicon dioxide, 33.1% aluminum oxide, 9.8% potassium oxide, 2.1% iron oxide, 0.8% sodium oxide, 0.7% magnesium oxide, 0.65% titanium dioxide, 0.50% calcium oxide and other constituents as residue).

EXAMPLE 3

The method of Example 2 was followed, using instead of mica, however, the same quantity of the mineral fiber INORPHIL 060 with a fiber length of less than 250 μm, more than 5% of which had a fiber length of less than 63 μm. This fiber is described as an asbestos-like synthetic fiber having an average composition by percentage of 46% silicon dioxide, 16% calcium oxide, 12% magnesium oxide, 15% aluminum oxide, 2.5% sodium oxide, 1.5% titanium dioxide, 6.5% iron oxide and 0.5% other constituents.

Comparative Tests

The high-temperature screw lubricants of the invention which were prepared according to the method described above were examined with respect to their frictional properties as compared to the various high-temperature screw lubricants of the prior art using examining methods which are known in this connection.

As steel test pieces in the high-temperature screw test an 8xM16x60 bolt, material no. 4980, a nut m16, material no. 4981, a washer, material no. 4986 was used.

The cycle of testing was 21 hours at 650° C.

Starting torque and break-away torque were measured by means of a torque wrench.

The coefficient of friction was determined on an ordinary, separate screw testing bench.

| | Coefficient of (1st Tightening) | Friction (2nd Tightening) | Starting Torque in Nm | Break-away Torque in Nm |
|---|---|---|---|---|
| Sample Paste | | | | |
| Example 1 | 0.10 | 0.10 | 90 | 110 |
| Example 2 | 0.12 | 0.11 | 90 | 130 |
| Example 3 | 0.12 | 0.11 | 90 | 130 |
| Comparative Paste | | | | |
| Never Seize Nickel Spezial (a) | 0.08 | 0.09 | 90 | 280–320 |
| Molykote 1000 (b) | 0.11 | 0.11 | 90 | 260 |
| Molykote HSC (c) | 0.10 | 0.09 | 90 | 220–240 |
| Molykote CU-7439 (d) | 0.10 | 0.10 | 90 | 200–210 |
| Molykote 505 (e) | 0.09 | 0.08 | 90 | 220 |

(a) = solid component based on nickel powder only
(b) = solid component based on graphite, copper, calcium fluoride and zinc powder
(c) = solid component based on copper powder, lead powder and molybdenum sulphide
(d) = solid component based on copper powder only
(e) = solid component based on mica powder and potassium titanate From the table above, it can be seen that the three pastes of the invention showed significantly lower break-away torques during high temperature thread testing versus known comparative pastes.

In practical application, the paste of the invention has been tested at 900° C. for 6 months. No metallurgical changes were observed in the metal and the threaded connections could be opened without difficulty.

We claim:

1. In a process of assembling and disassembling threaded connections which have applied thereto a high temperature screw lubricating paste, the improvement comprising using as said lubricating paste a homogeneous composition consisting essentially of: (A) from 30 to 75 percent by weight of a finely divided solid mixture of tin dioxide with an inorganic filler selected from mineral silicates, synthetic silicates, metal oxides or heavy metal powders, wherein the ratio of said filler to said tin dioxide is between 0:1 and 3:1 and said filler is thermally stable up to 1200° C.; and (B) from 25 to 70 percent by weight of a carrier oil selected from mineral oil, synthetic oils or mixtures of mineral oil with synthetic oil, whereby said threaded connections are easily disassembled after exposure to temperatures of up to about 1200° C.

2. The process according to claim 1, wherein said solid mixture of component (A) is from 40 to 60 percent by weight of said composition.

3. The process according to claim 1, wherein said ratio of filler to tin dioxide in component (A) is 1:1 to 3:1.

4. The process according to claim 2, wherein said ratio of filler to tin dioxide in component (A) is 1:1 to 3:1.

5. The process according to claim 3, wherein said ratio of filler to tin dioxide in component (A) is 1.5:1 to 2.5:1.

6. The process according to claim 4, wherein said ratio of filler to tin dioxide in component (A) is 1.5:1 to 2.5:1.

7. The process according to claim 3, wherein said filler is selected from an inosilicate or a phyllosilicate.

8. The process according to claim 5, wherein said filler is selected from an inosilicate or a phyllosilicate.

9. The process according to claim 3, wherein said filler is selected from asbestos, mica or a synthetic mineral fiber.

10. The process according to claim 5, wherein said filler is selected from asbestos, mica or a synthetic mineral fiber.

* * * * *